US006069344A

United States Patent [19]

Krasznai et al.

[11] Patent Number: 6,069,344

[45] Date of Patent: May 30, 2000

[54] CONVECTION FEATURE FOR USE IN OVENS

[75] Inventors: Charles Z. Krasznai, Fairfield; Bernard Bensussan, Monroe; Michael A. Andrew, Milford, all of Conn.

[73] Assignee: HP Intellectual Corp., Wilmington, Del.

[21] Appl. No.: 09/239,068

[22] Filed: Jan. 27, 1999

[51] Int. Cl.[7] ..... A21B 1/26

[52] U.S. Cl. ..... 219/400; 126/214

[58] Field of Search ..... 219/400; 34/221, 34/219, 225, 231; 99/474, 476; 126/214

[56] References Cited

U.S. PATENT DOCUMENTS

| | | | |
|---|---|---|---|
| Re. 31,765 | 12/1984 | Guibert | 219/400 |
| 1,203,235 | 10/1916 | Morriss | 219/400 |
| 1,218,341 | 3/1917 | Truitt . | |
| 1,286,576 | 12/1918 | Freas | 219/400 |
| 1,825,790 | 10/1931 | Hansen . | |
| 2,214,630 | 9/1940 | Wheeler | 219/35 |
| 2,898,437 | 8/1959 | McFarland | 219/35 |
| 2,966,573 | 12/1960 | Hansen | 219/35 |
| 3,160,153 | 12/1964 | Drayer | 126/21 |
| 3,279,451 | 10/1966 | Oehring | 126/21 |
| 3,468,815 | 9/1969 | Robinson | 219/400 |
| 3,474,225 | 10/1969 | Leedy | 219/400 |
| 3,538,904 | 11/1970 | Baker | 126/21 |
| 3,586,516 | 6/1971 | Terc | 99/234 |
| 3,614,388 | 10/1971 | Robinson | 219/400 |
| 3,681,557 | 8/1972 | Suzuki et al. | 219/10.55 |
| 3,719,180 | 3/1973 | Pere | 126/21 |
| 3,828,760 | 8/1974 | Farber et al. | 126/21 |
| 3,839,622 | 10/1974 | Mastin | 219/400 |
| 3,855,451 | 12/1974 | Lee | 219/400 |
| 3,905,760 | 9/1975 | Johansson et al. | 432/176 |
| 3,911,893 | 10/1975 | Baker et al. | 126/21 |
| 4,010,341 | 3/1977 | Ishammar | 219/400 |
| 4,029,463 | 6/1977 | Johansson et al. | 432/25 |
| 4,068,572 | 1/1978 | Vogt | 99/447 |
| 4,132,216 | 1/1979 | Guibert | 126/261 |
| 4,155,294 | 5/1979 | Langhammer et al. | 99/427 |
| 4,250,955 | 2/1981 | Plattner et al. | 219/400 |
| 4,295,419 | 10/1981 | Langhammer | 219/400 |
| 4,357,522 | 11/1982 | Husslein et al. | 219/400 |
| 4,374,318 | 2/1983 | Gilliom | 219/400 |
| 4,374,319 | 2/1983 | Guibert | 219/400 |
| 4,381,442 | 4/1983 | Guibert | 219/400 |
| 4,381,443 | 4/1983 | Guibert | 219/400 |
| 4,397,875 | 8/1983 | Gilliom | 426/523 |
| 4,426,923 | 1/1984 | Ohata | 99/468 |
| 4,430,541 | 2/1984 | Day, Jr. | 126/21 A |
| 4,455,478 | 6/1984 | Guibert | 219/400 |
| 4,481,396 | 11/1984 | Matsubayashi et al. | 219/10.55 |
| 4,494,683 | 1/1985 | Kleber | 223/51 |
| 4,512,327 | 4/1985 | Stiegler | 126/21 |
| 4,561,348 | 12/1985 | Halters et al. | 99/421 |
| 4,780,596 | 10/1988 | Matsushima et al. | 219/400 |
| 4,829,158 | 5/1989 | Burnham | 219/400 |
| 4,870,254 | 9/1989 | Arabori et al. | 219/400 |
| 5,193,520 | 3/1993 | Gostelow et al. | 126/21 |
| 5,228,385 | 7/1993 | Friedrich et al. | 99/352 |
| 5,532,456 | 7/1996 | Smith et al. | 219/400 |
| 5,584,233 | 12/1996 | Glucksman et al. | 99/474 |
| 5,786,567 | 7/1998 | Wang | 219/400 |
| 5,801,362 | 9/1998 | Pearlman et al. | 219/400 |

*Primary Examiner*—Joseph Pelham
*Attorney, Agent, or Firm*—Barry E. Deutsch

[57] ABSTRACT

The invention resides in an oven which is capable of recirculating air in a laminar pattern around food stuff supported within the oven cavity. The heating elements of the oven are disposed at the lower portion of the oven with the food stuff being supported thereabove. Air which is drawn in by an impeller at the top of the cavity is driven downwardly through a duct and redirected below the food and across heating element(s) and thereafter redirected upward in a recirculating pattern to effect uniform cooking of the food stuff located therein.

9 Claims, 7 Drawing Sheets

CONVECTION FEATURE FOR USE IN OVENS

The present invention relates to an oven for broiling, cooking, roasting, defrosting and/or baking food and relates more particularly to the design of a cooking chamber whereby a fan and associated housing disposed within the oven causes heated air within the oven to circulate in a manner which effects improved cooking of the food which is disposed therein.

It is desirable to cook food evenly and with a uniformity of heat so that superior cooking results are affected. It has been found in ovens wherein the heating element is located on the bottom of the chamber, that the air around the heating element becomes stagnant and is usually trapped under the tray disposed above it. This undesirably causes over cooking of the bottom of the food which is disposed juxtaposed above the heating element. Thus, it is desirable to recirculate air from the top of the oven to the bottom in a circular path. This arrangement assures that air in the oven is recirculated in the most efficient way. Designs on the market today simply mix up the air inside of the oven in a random fashion such as found in turbulent patterns as disclosed in U.S. Pat. No. 3,828,760. The problem with such designs is that these designs are too dependent on the size and shape of the foodstuff to be cooked. Such foods get in the way of turbulence patterns and act as obstacles to the airflow creating undesirable hot and cool areas in the oven cavity.

Also, as is known, commercial convection ovens are typically rather large and expensive, but are effective cooking tools. Such ovens have designs which are based on the need of the professional cooks and bakers. They typically do not physically fit most kitchens and within most consumer budgets. They provide superior cooking results and long operating life and are rugged to accommodate the abuses due to production type cooking. Usually such convection ovens require the use of an exhaust fan and/or special installation constraints that may or may not be available or feasible in household kitchens. One alternative to this would be found in a consumer full size convection range oven. These ovens are more suited for use in conventional consumer kitchens but pricewise their cost may be prohibitive. These types of convection range ovens simply fit the same space as would be found in a conventional range oven.

Finally, consumer auxiliary ovens or small ovens or toaster ovens with convection features are presently available. However, because of size and cost constraints, these ovens do not perform as well as their full size counterpart such as discussed above.

Accordingly, it is an object of the present invention to provide a convection oven of a design which fits within the space limitations of a traditional small oven or toaster oven space, yet offers the performance of its larger counter part ovens.

It is still a further object of the invention to provide an oven of the aforementioned type wherein the general arrangement of elements in the oven can also be applied to midsized auxiliary ovens.

It is yet still a further object of the invention to provide a convection oven of the aforementioned type wherein the convection feature is designed as a module that can be added to regular small ovens, auxiliary ovens, or to toaster ovens with minimum assembly line disturbances.

Yet still a further object of the invention is to provide a convection oven of the aforementioned type wherein airflow management is optimized to provide superior performance, comparable to that of a full size convection range oven or commercial convection oven.

Still yet a further object of the invention is to provide a convection oven of the aforementioned type which is less expensive to manufacture with respect to the business restraints of the consumer market.

Another object of the invention is to provide a heating pattern for air within an oven which envelopes the food regardless of the size or shape of the air stream.

SUMMARY OF THE INVENTION

The invention resides in an improved oven with a convection feature having a fan tuned to circulate the air cavity so as to evenly cook the food which is placed in it for cooking. More specifically, the invention resides in an oven comprised of a frame supporting a door and an interior housing defining an interior cavity having opposed upper and lower walls, opposed sidewalls and a rear wall. One of the rear and opposed sidewalls is vertically extending and has an impeller means disposed thereon. The impeller means is located within the oven interior cavity generally adjacent the upper housing wall of the cavity and a subhousing substantially covering the impeller means, the subhousing having means for drawing air from the region of the cavity adjacent the upper wall and having a discharge opening located below the impeller means to effect discharge of air downwardly toward the bottom wall of the cavity. A heating means is disposed within the cavity for heating the cavity.

Ideally, the heating means is located adjacent the lower wall of the cavity and each of the opposed sidewalls includes support means for holding a rack in position thereon.

Preferably, the heating means is disposed below the supporting elements and the impeller means is mounted to the frame of the oven and includes a drive motor having an output shaft on which a first and a second impeller element are mounted.

In one embodiment, the first impeller element is disposed within a duct communicating with a vent for cooling the drive motor and the second impeller element is substantially separated from the first impeller element by the rear wall.

Ideally, the subhousing includes a duct portion having an opening which is downwardly directed and the cavity including a first deflecting housing portion which is located in line with the duct portion and redirects the exhausted air from the duct portion horizontally across the lower wall and a second deflecting housing portion is provided in the cavity and is disposed oppositely of the first deflecting housing portion for redirecting air off the first deflecting wall and upwardly into the cavity.

It is desirable that a plurality of catch members are correspondingly sized and shaped to be received within vertically extending slots formed in the rear wall for mounting the subhousing thereon and over the impeller means and the second impeller being sized and the motor being of a power such as to circulate air in the cavity between one and four times a minute.

DETAILED DESCRIPTION OF THE PREFERRED EMBODIMENTS

As illustrated, the oven illustrated generally as 2 embodies the present invention. The oven 2 includes a control panel 4 for controlling the heat of the oven, a transparent door 6 which is hingedly attached to the oven 2 and an interior cavity 8 in which is disposed the foodstuff to be cooked.

Figure 1:
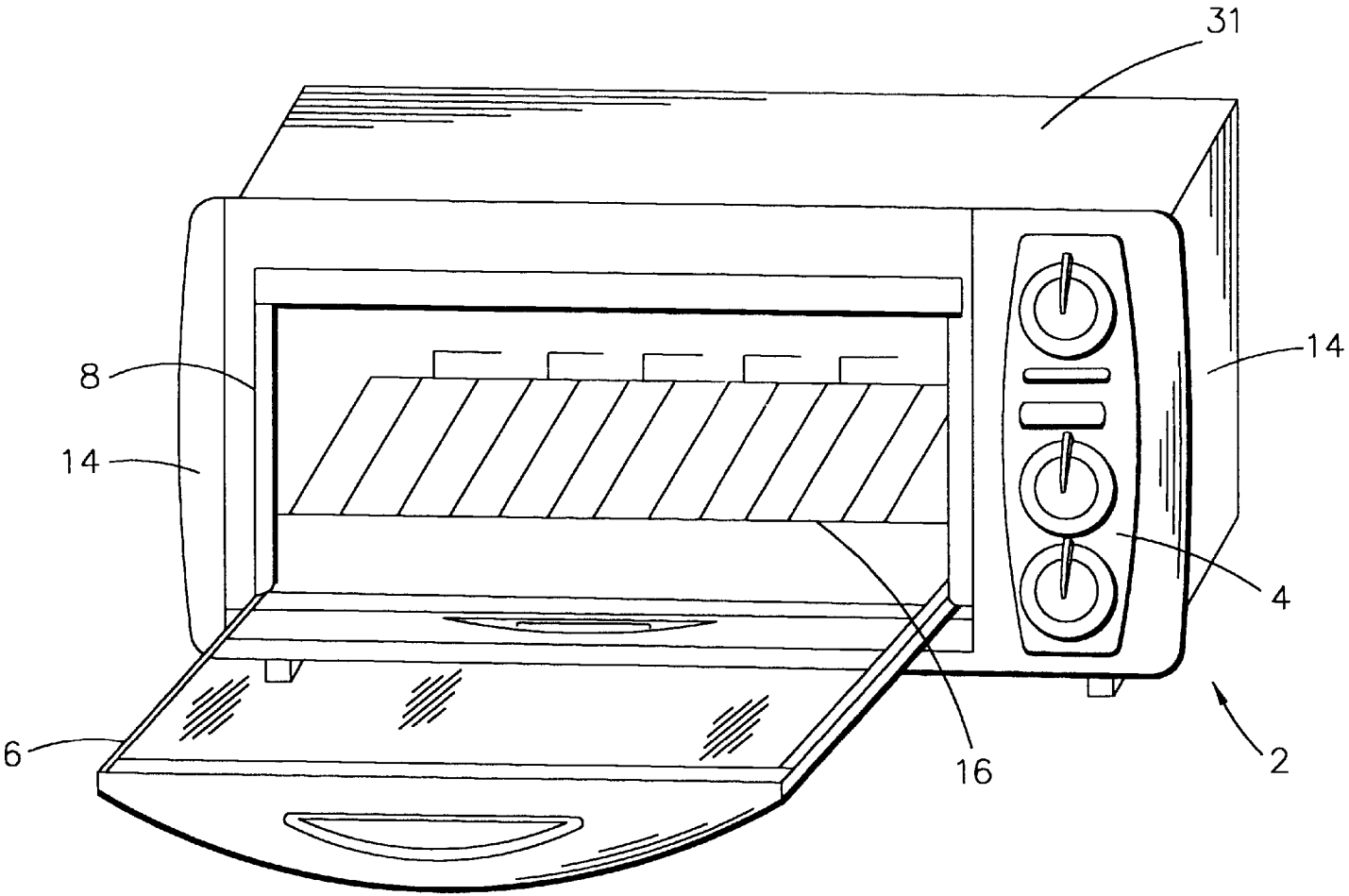
FIG. 1 is a perspective view of the oven of the present invention.
Figure 2:
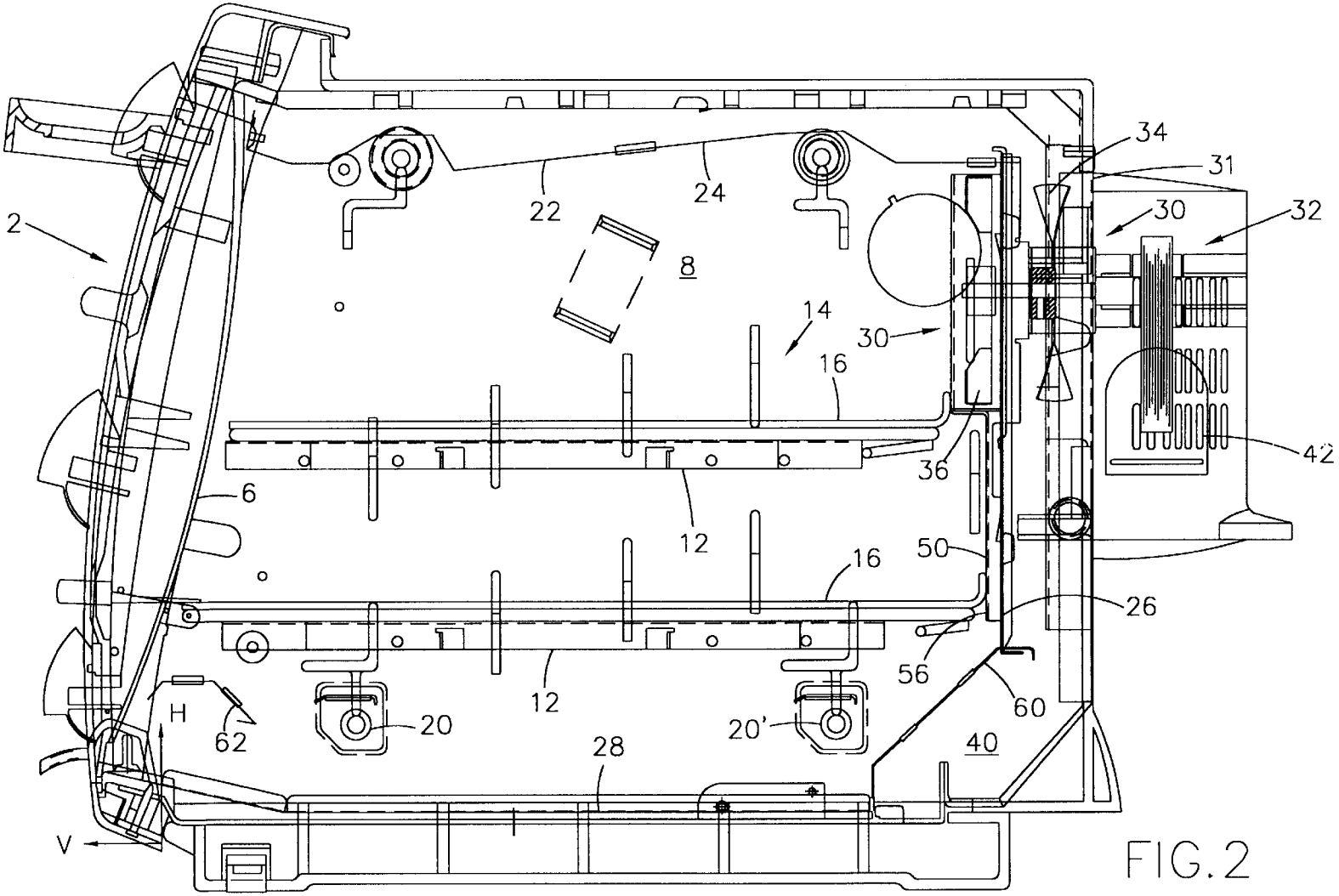
FIG. 2 is a vertical section through the oven shown in FIG. 1.

Referring now to FIG. 2, it should be seen that the interior cavity 8 which is defined by two opposed side walls 14,14 includes vertically oriented supports 12, 12' which are located on respective ones of the opposite sidewalls 14,14 of the oven to provide supports against which rack(s) 16 is supported. For purposes of illustrating two racks can be used within the oven cavity 8 so that each is disposed at a different height level when in the dual rack mode of the oven. The two racks 16,16 are shown in FIG. 2, but it is entirely within the purview of the invention to use a single rack 16 either on the higher elevated supports 12' or exclusively on the lower end supports 12 depending on the application which the user would like to make of the oven.

Disposed below the rack supports 12,12' are transversely extending heating elements 20,20' which are provided for the purpose of heating the interior confines of the cavity 8. The cavity 8 is further defined by a housing 22, which together with the side walls 14,14 creates a cave-like structure. To these ends, the housing is further defined by an upper wall 24 extending generally horizontally between the front and rear ends of the oven, a rear wall 26 extending vertically between the top and bottom regions of the cavity and a bottom wall 28 which extends horizontally back across the lower region of the oven between the rear wall 26 and the door 6.

Figure 4:
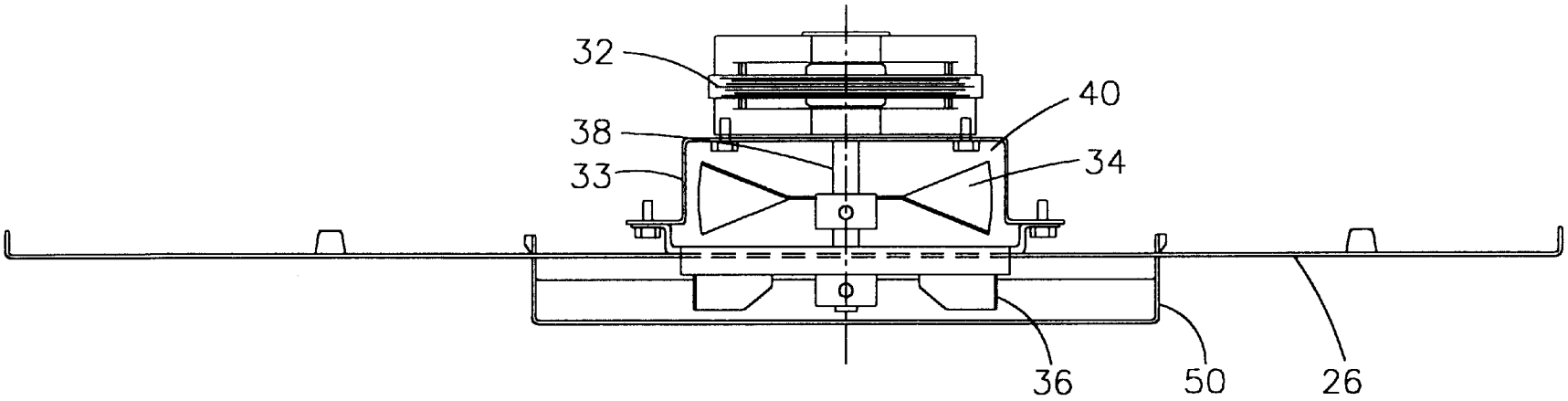
FIG. 4 is a horizontal view through the panel of FIG. 3.
Figure 5:
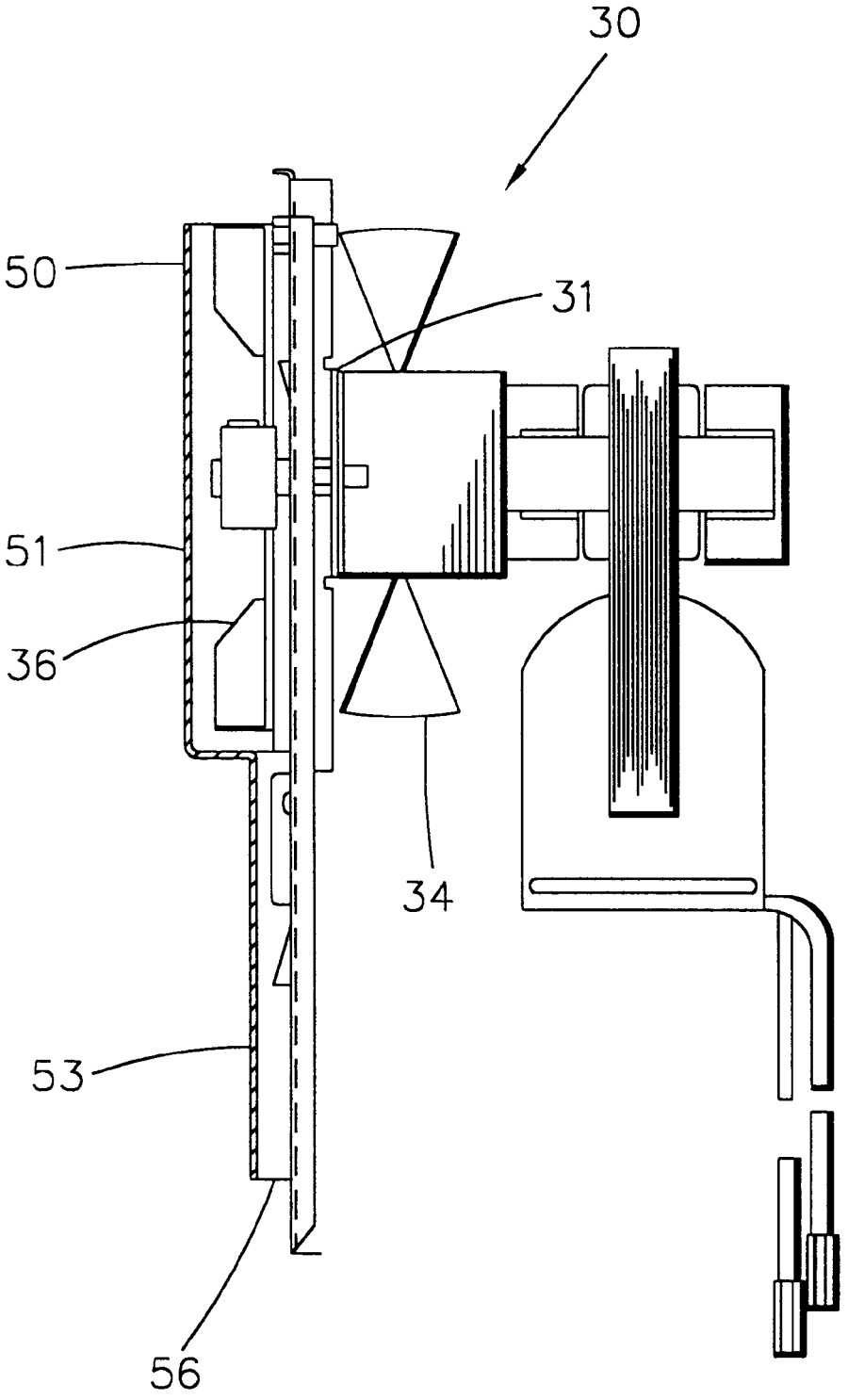
FIG. 5 is a vertical section through the panel shown in FIG. 4.
Figure 7:
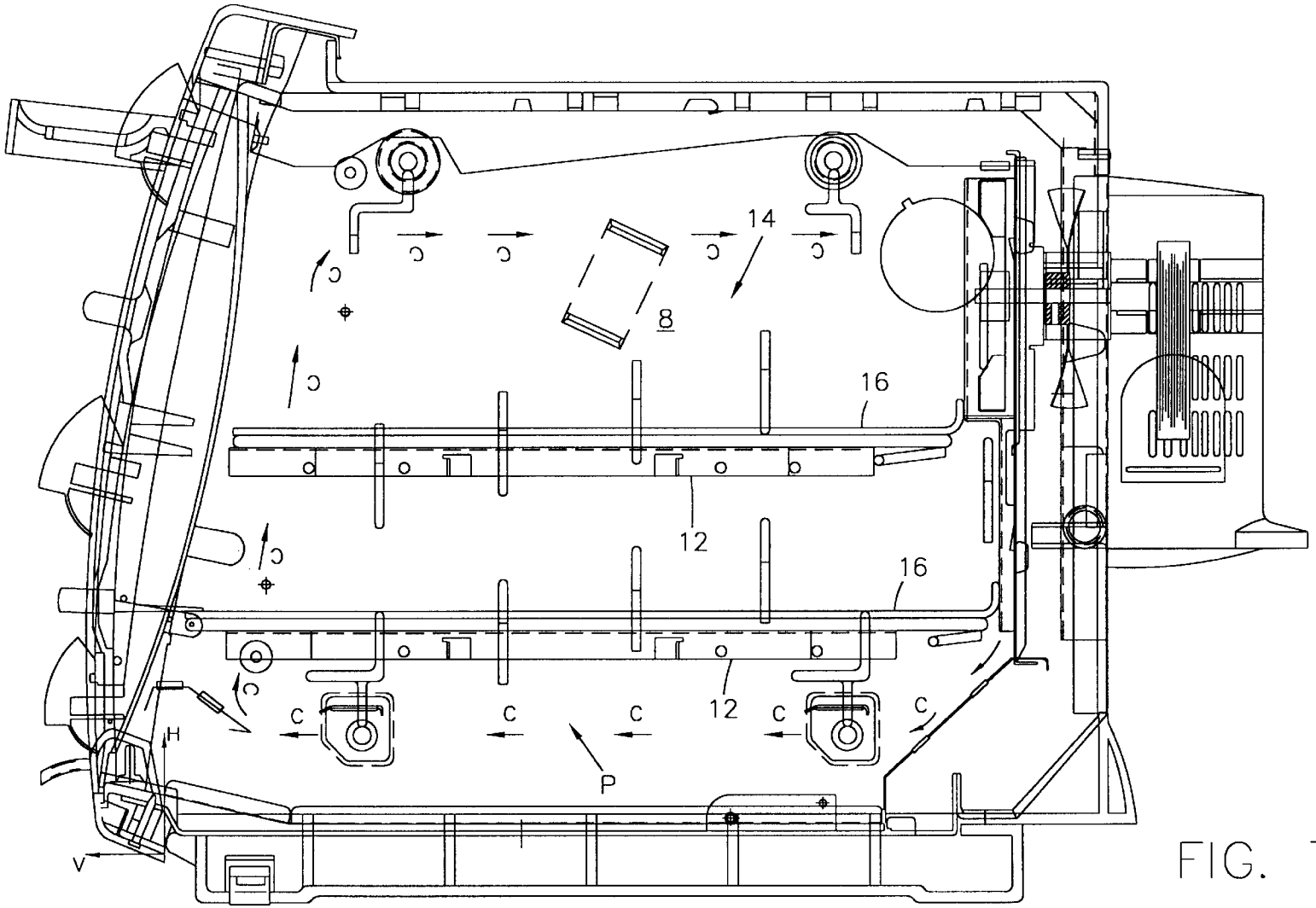
FIG. 7 shows the air flow pattern of the invention.

In accordance with the invention, the rear wall 26 is provided with a recirculating means 30 responsible for creating a novel and unobvious air flow pattern within the cavity 8 as illustrated within FIG. 7. For this purpose, the means 30 includes a drive motor 32 which is mounted to an assembly 31 in turn mounted to the frame 33 of the oven 2 which is spaced from the rear wall 26 of the interior housing. The means 30 further includes a first impeller 34 located between the frame 31 and the rear wall 26 for cooling the drive motor 32 and a second impeller or convection fan 36 disposed within the oven cavity 8 for effecting the recirculation of the heated air as illustrated in FIG. 7. As illustrated in FIGS. 4 and 5, the first and second impellers 34 and 36 are disposed coaxially about a common driven shaft 38 of the motor 32 so as to rotate in unity with one another. The first impeller 34 (see FIG. 4) is disposed within a duct 40 which communicates with vent openings formed in the oven face for drawing air through the duct 40 and across the drive motor 32 and out rear vent openings 42.

Figure 3:
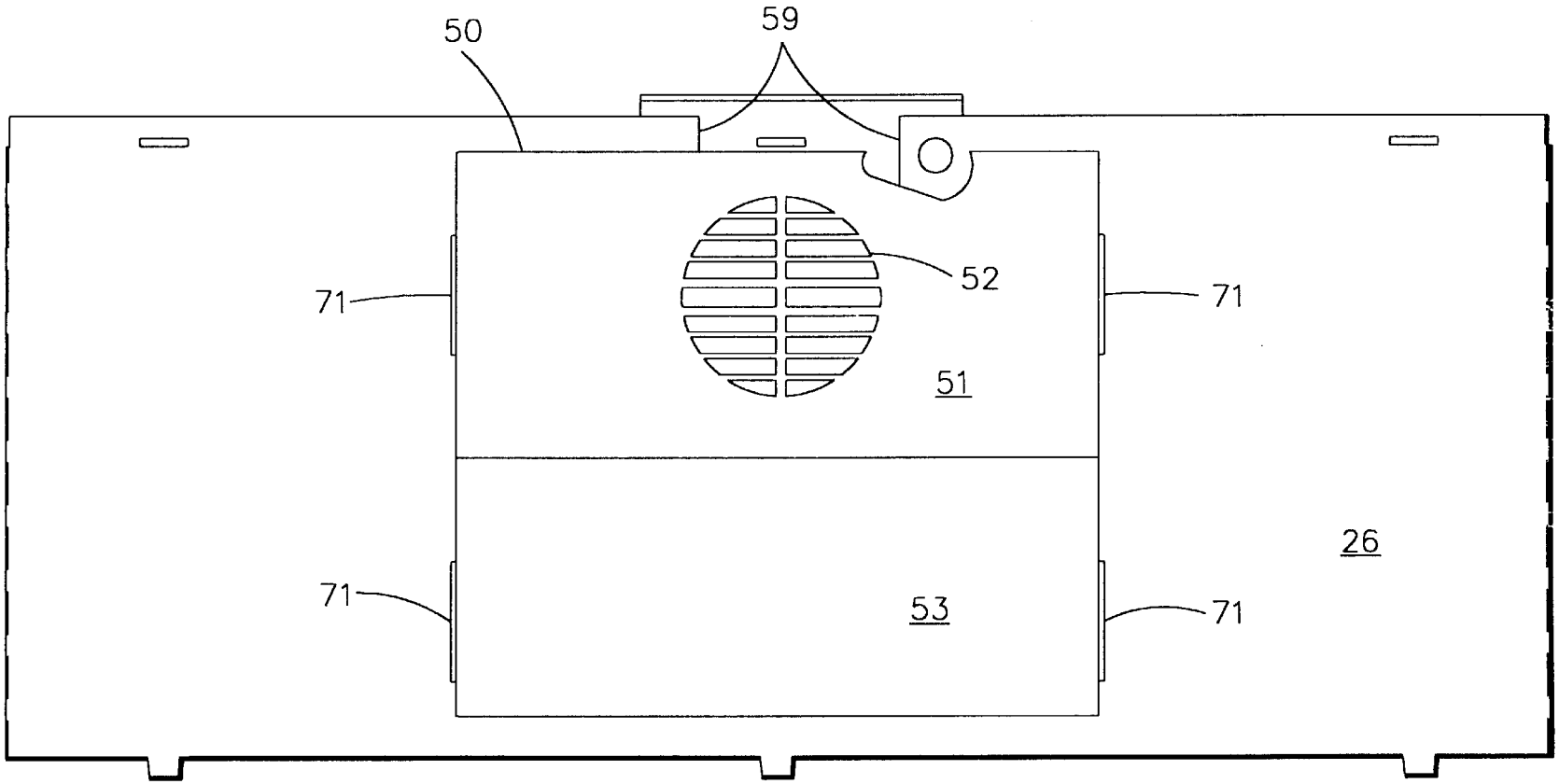
FIG. 3 is a front elevation view of the rear panel of the convection oven shown in FIGS. 1 and 2.

As illustrated in FIGS. 3 and 4, the rear end wall 26 of the cavity 8 carries a subhousing 50 which has a generally flag shaped profile having an upper portion 51 which surrounds the second impeller 36 and an integrally connected depending duct portion 53 having an opening 56 communicating with the oven cavity 8. The subhousing 50, as illustrated in FIG. 3, has a plurality of vent openings 52 formed in the front face thereof. The vent openings 52 are aligned generally coincidentally with the outline of the convection fan 36 so as to provide an intake opening for drawing air from the upper area of the cavity 8 and forcing it downwardly through the depending duct portion 53. As seen in FIG. 3, the rear end wall 26 is interrupted at 59,59 to allow passage of the common drive shaft 38.

Figure 6C:
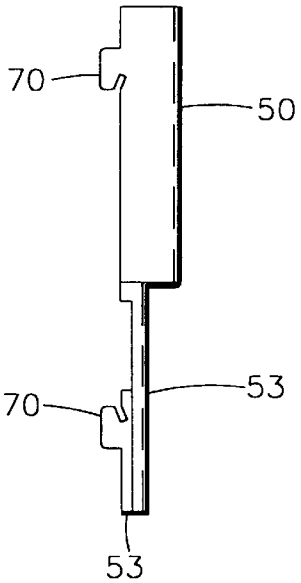
FIG. 6C is a side elevation view of the subpanel shown in FIGS. 6A and 6B.
Figure 6B:
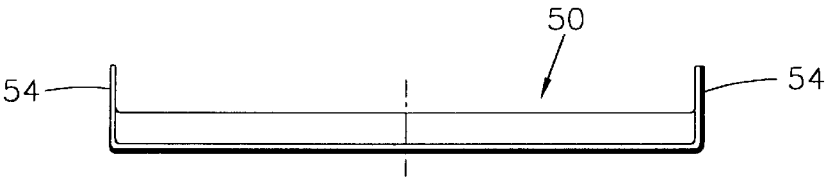
FIG. 6B is a top plan view of the subpanel shown in FIGS. 6C and 6A.
Figure 6A:
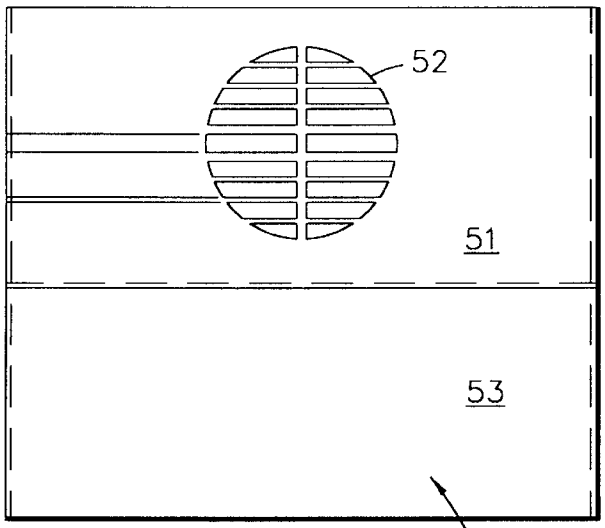
FIG. 6A is a front elevation view of a subpanel on the panel shown in FIG. 3.

As best illustrated in FIGS. 6A, 6B and 6C, the subhousing 50 has sidewalls 54,54 which extend vertically along the entire length of the subhousing 50 to laterally constrain the air drawn through the vent openings 52 to movement downwardly through the duct portion 53 and out the bottom outlet 56 (see FIG. 2). In this way, as illustrated in FIG. 7, the heated air which is otherwise collected at the top of the cavity 8, is drawn through the vent openings 52 of the subhousing 50 and is thereafter forced to follow a desired path P through the cavity 8 as described below.

In order to cause the circulation effect or circular laminar effect of the air moved by the impeller 36 once it exits the depending duct portion 53 of the subhousing 50, a first deflecting wall 60 (See FIG. 2) is provided as part of the interior housing between the rear wall 26 and the lower wall 28. The first deflecting wall 60 is disposed at an angle of approximately 60° and causes the otherwise downwardly directed heated air from the outlet 56 to be moved horizontally across the bottom wall 28 in an aft to fore direction whereupon it is again met by second deflecting wall 62 which in turn redirects the otherwise horizontally traveling air in a vertical direction to effect the circular laminar flow of the air within the cavity 8. It should be understood that the second impeller 36 is sized and the drive motor 32 is of a power such as to circulate air in the cavity 8 between one and four times a minute.

As illustrated in FIG. 6C, it is a feature of the subhousing 50 to be readily attached and separated from the endwall panel 26. For this purpose, the endwall 26 has a plurality of vertically disposed slots 71,71 (see FIG. 3) which are located so as to receive a correspondingly positioned catch 70,70 stamped in place as part of the unitary sidewalls 54,54.

By the foregoing an improved convection oven has been disclosed by way of preferred embodiment. However, numerous modifications and substitutions may be had without departing from the spirit of the invention. For example, the convection oven may include a second stage fan/motor assembly designed to take cool air from outside the oven cavity and blow it between the outer layers of the oven exterior wall such as in the case of a cool touch oven which helps achieving a cool touch exterior surface and/or improving the performance of existing cool touch housing design. Accordingly, the invention has been described by way of illustration rather than limitation.

What is claimed is:

1. An oven comprising:

a frame supporting a door and an interior housing defining an interior cavity having opposed upper and lower walls, and opposed sidewalls and a rear wall;

one of said rear and opposed sidewalls being vertically extending and having an impeller means disposed thereon;

said impeller means being located within said interior cavity generally adjacent said upper housing wall of said cavity and a subhousing substantially covering said impeller means, said subhousing having means for drawing air from the region of said cavity adjacent said upper wall and having a single discharge opening located below said impeller means to effect discharge of air downwardly toward the lower wall of said cavity;

heating means disposed within said cavity for heating said cavity;

said subhousing further including a duct portion communicating said impeller means with said single discharge opening; and said cavity including a first deflecting wall disposed vertically in line with said discharge opening, said first deflecting wall being angularly disposed relative to said rear and sidewalls to direct said downwardly flowing air in a horizontal flow path towards said door; and a second deflecting wall mounted substantially adjacent to said door and being angularly disposed relative to said door and sidewalls to redirect said horizontally moving air in a vertical direction.

2. An oven as defined in claim 1 further characterized by said heating means being located adjacent said lower wall of said cavity.

3. An oven as defined in claim 2 further characterized by each of said opposed sidewalls including support means for holding a rack in position thereon;

and wherein said heating means is disposed below said supporting means.

4. An oven as defined in claim 3 further characterized by said impeller means being mounted to the frame of said oven and includes a drive motor having an output shaft on which a first and a second impeller element are mounted.

5. An oven as defined in claim 4 further characterized by said first impeller element being disposed within a duct communicating with a vent for cooling said drive motor.

6. An oven as defined in claim 4 further characterized by said second impeller element being substantially separated from said first impeller element by said rear wall.

7. An oven as defined in claim 6 further characterized by said subhousing having a plurality of catch members which are correspondingly sized and shaped to be received within vertically extending slots formed in said rear wall for mounting said subhousing thereon and over said impeller means.

8. An oven as defined in claim 6 further characterized by said subhousing being formed from bent sheet metal.

9. An oven as defined in claim 8 further characterized by said second impeller being sized and said motor being of a power such as to circulate air in said cavity between one and four times a minute.

* * * * *